US006612665B2

(12) United States Patent
Nielsen

(10) Patent No.: US 6,612,665 B2
(45) **Date of Patent: *Sep. 2, 2003**

(54) COMPUTER KEYBOARD ENCLOSURE WITH WORK SURFACE

(75) Inventor: Andreas K. Nielsen, Valley Center, CA (US)

(73) Assignee: Aspen Furniture Design, Inc., Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/728,642

(22) Filed: Dec. 1, 2000

(65) Prior Publication Data

US 2002/0125798 A1 Sep. 12, 2002

Related U.S. Application Data

(62) Division of application No. 09/264,469, filed on Mar. 8, 1999, now Pat. No. 6,158,829.

(51) Int. Cl.[7] ..... A47B 81/00
(52) U.S. Cl. ..... 312/208.1; 312/223.3
(58) Field of Search ..... 312/208.1, 208.2, 312/208.3, 223.3, 194, 195, 196, 310, 313, 330.1, 311, 348.5, 302; 108/50.01, 50.02, 93

(56) References Cited

U.S. PATENT DOCUMENTS

| | | | | | |
|---|---|---|---|---|---|
| 670,370 | A | * | 3/1901 | Dewhurst | 312/208.1 X |
| 756,761 | A | * | 4/1904 | Wood | 312/302 X |
| 1,181,739 | A | | 5/1916 | Clark | |
| 1,254,991 | A | * | 1/1918 | Darst | 312/302 X |
| 1,692,665 | A | * | 11/1928 | Knaster | 312/311 X |
| 2,329,029 | A | * | 9/1943 | Bargen et al. | 312/208.1 X |
| 2,893,533 | A | * | 7/1959 | Childs | 312/208.1 X |
| 2,893,808 | A | | 7/1959 | Waterman | |
| 3,317,260 | A | * | 5/1967 | Levit et al. | 312/302 X |
| 3,970,010 | A | * | 7/1976 | Cantley | 312/311 X |
| 4,313,112 | A | | 1/1982 | Foster | |
| 4,657,214 | A | * | 4/1987 | Foster | 312/311 X |
| 4,755,009 | A | | 7/1988 | Price et al. | |
| 4,766,422 | A | * | 8/1988 | Wolters et al. | 312/223.3 X |
| 4,869,564 | A | | 9/1989 | Lechman | |
| 4,893,775 | A | | 1/1990 | Long | |
| 5,071,204 | A | | 12/1991 | Price et al. | |
| 5,094,514 | A | | 3/1992 | Grosch | |
| 5,205,631 | A | * | 4/1993 | Wegman et al. | 312/208.1 X |
| 5,248,192 | A | * | 9/1993 | Tazzia | 312/208.1 X |
| 5,383,643 | A | | 1/1995 | Koch | |
| 5,419,704 | A | * | 5/1995 | North | 312/208.3 X |
| 5,424,912 | A | | 6/1995 | Mikan | |
| 5,502,460 | A | | 3/1996 | Bowen | |
| 5,558,418 | A | * | 9/1996 | Lambright et al. | 312/208.1 X |
| 5,568,773 | A | * | 10/1996 | Hung | 312/223.3 X |
| 5,803,744 | A | | 9/1998 | Yen | |
| 5,957,059 | A | | 9/1999 | Burhman | |
| 6,010,262 | A | | 1/2000 | Linyear et al. | |
| 6,042,075 | A | * | 3/2000 | Burch, Jr. | 248/442.2 |

FOREIGN PATENT DOCUMENTS

| | | | | |
|---|---|---|---|---|
| CH | 126158 | * | 6/1928 | 312/311 |

* cited by examiner

*Primary Examiner*—James O. Hansen
(74) *Attorney, Agent, or Firm*—William R. Bachand; Stuart A. Whittington; Squire, Sanders & Dempsey L.L.P.

(57) ABSTRACT

A unit of furniture, useful as a computer such as a desk, cabinet, or armoire, includes a pullout unit that extends from the unit of furniture. The pullout unit includes a tray for supporting a computer keyboard and mouse. The tray may be covered by a movable lid that provides a first writing surface over the tray when covering the tray and a second writing surface when moved to a position for supporting copy referenced while using the keyboard. The pullout unit may also include an extension unit mounted adjacent to the tray and extendable to provide additional writing surface. The extension unit may include a drawer that extends toward the tray. The pullout unit may include a lid stop to cooperate with the unit of furniture to maintain the pullout unit in a stable extended position.

15 Claims, 7 Drawing Sheets

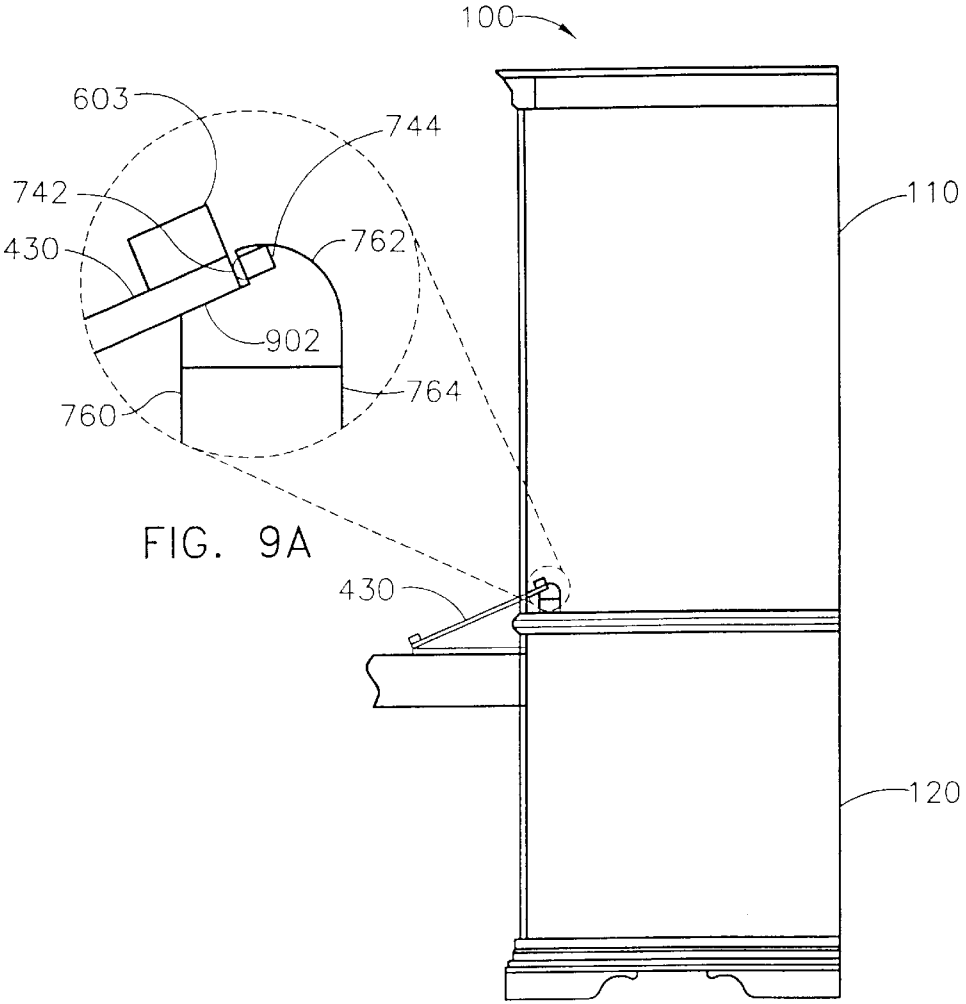
FIG. 9
FIG. 9A
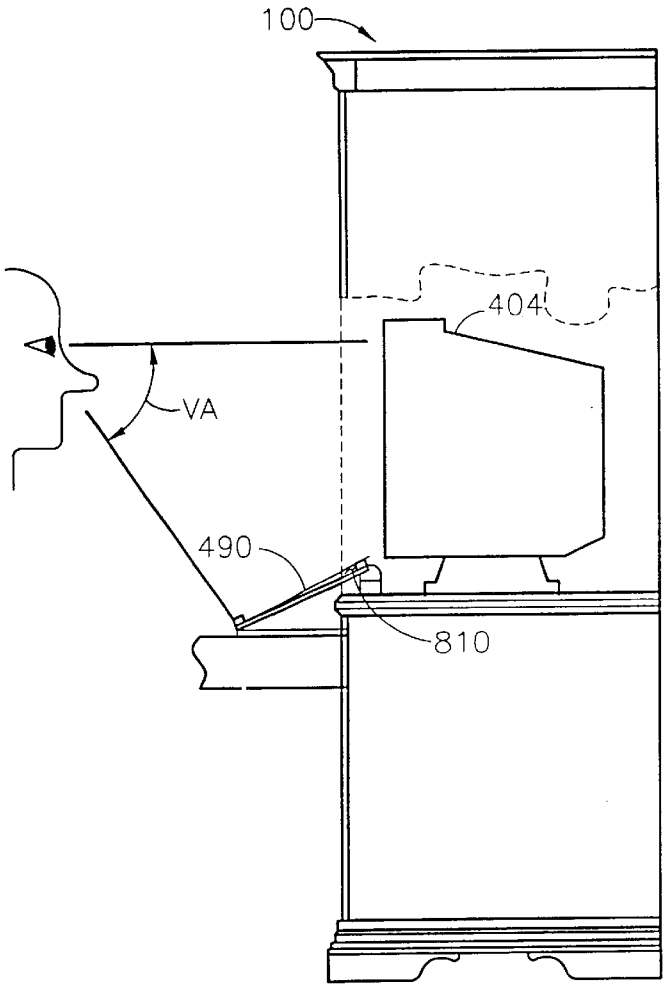
FIG. 8

COMPUTER KEYBOARD ENCLOSURE WITH WORK SURFACE

This is a divisional of patent application Ser. No. 09/264,469 filed on Mar. 8, 1999 now U.S. Pat. No. 6,158,829.

BACKGROUND OF THE INVENTION

In general, furniture units such as desks, cabinets and armoires with provisions for holding computer equipment are known. An example of a desk including provisions for holding a computer is described in U.S. Pat. No. 5,741,053 issued to Andreas Krestian Nielsen on Apr. 21, 1998. However, known units typically provide only limited writing surfaces and/or manifest an inconveniently large footprint. To add writing surface, some known armoires provide a flip-down writing table. However, such flip-down tables tend to prevent ready access to drawers and other storage; and, may present a danger of physical injury. Further, such tables are unsuitable for providing storage for loose accessories because they are regularly tilted through a 90 degree arc.

Accordingly, there is a need for an armoire that provides a compact yet convenient work environment for a computer user, disposes computer equipment in a position for convenient use, and provides storage spaces and writing surfaces conveniently arranged within the immediate work area of the user. There is also a need for a compact (small footprint) computer armoire that provides an adequate writing surface even when a computer keyboard is being used.

SUMMARY OF THE INVENTION

In accordance with one aspect of the of the present invention, provision is made in a compact (small footprint) unit of furniture for a writing surface while a keyboard is in use; a retractable pullout unit with a compartment for a keyboard and mouse; and an additional portion adjacent to the compartment providing a first writing surface. A hinged lid overlies the compartment, adapted to be arranged in either lowered or raised positions as desired. When in the lowered position, the lid provides a second writing surface substantially co-planar with the first writing surface. While in the raised position, the lid provides a supporting surface for papers that an operator may wish to view while using the keyboard, and additionally stabilizes the pullout unit position.

BRIEF DESCRIPTION OF THE DRAWING

Embodiments of the present invention will now be described with reference to the drawing, wherein like designations denote like elements, and:

FIG. 8 is a side view of the computer armoire of FIG. 1 illustrating an advantageous viewing angle; and FIG. 9 is a side view of the computer armoire and pullout unit of FIG. 1 illustrating a catch mount for securing the pullout unit.

DESCRIPTION OF PREFERRED EXEMPLARY EMBODIMENTS

Figure 1:
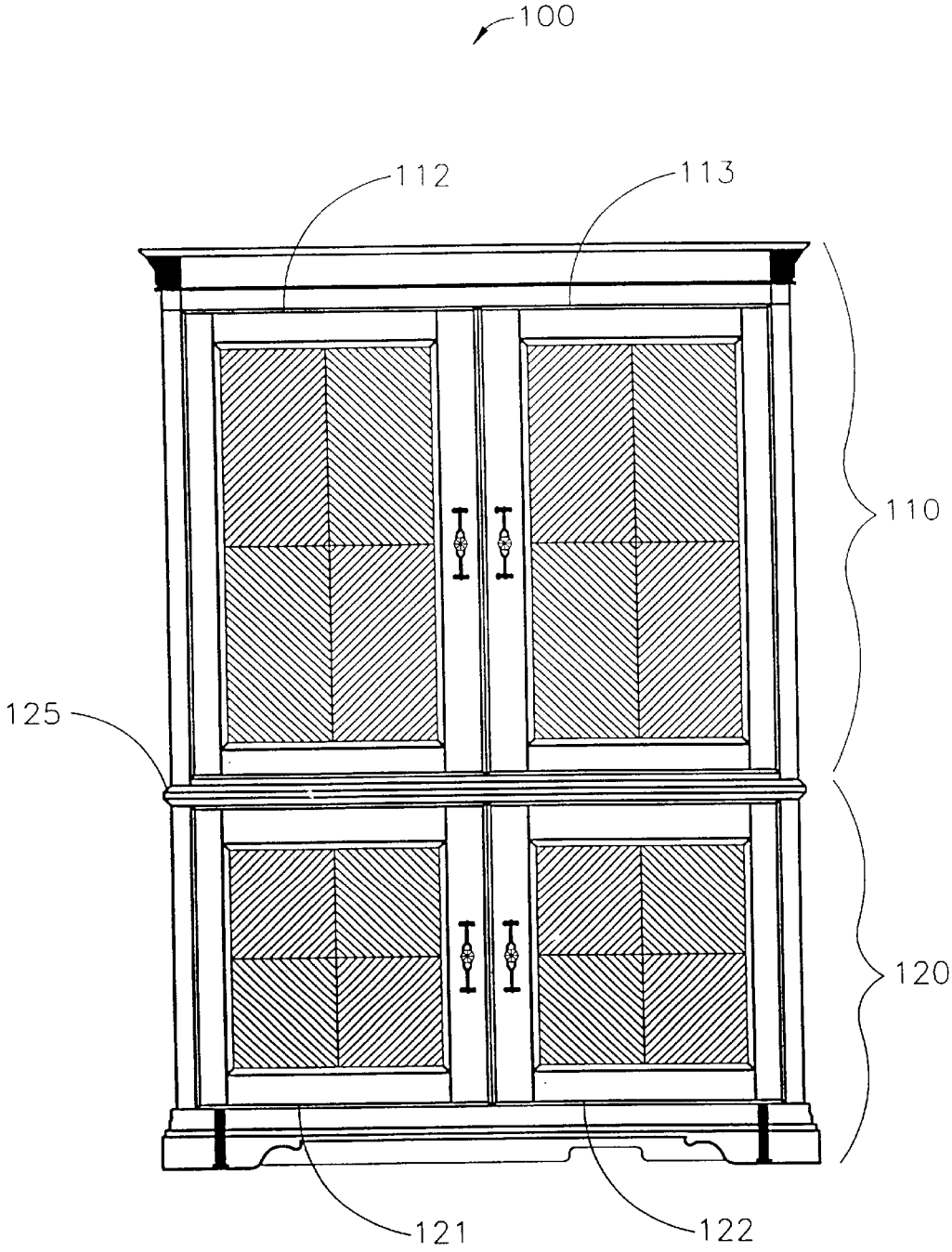
FIG. 1 is a front exterior view of a computer armoire according to various aspects of the present invention.

The present invention provides for a compact (small footprint) yet convenient work environment for a computer user. For example, referring to FIGS. 1, 2, 8, and 9, a unit of furniture (e.g., desk, cabinet, armoire, etc.) incorporating the present invention suitably includes a base (lower section) 120 having a generally horizontal top piece 125, a pullout unit 260 slideably mounted in base 120 beneath top piece 125, and a catch bar (lid stop) 760 suitably disposed on the upper surface of top piece 125. If desired, an upper section 110 may also be employed, suitably separable from lower section 120 for convenience of transportation. Upper section 110 rests on the upper surface of top piece 125 of lower section 120, and may include a horizontal bottom piece 210 generally co-extensive (albeit, slightly smaller) and overlying lower section top piece 125. If an upper section 110 is employed having a bottom piece 210, lid stop 760 is suitably affixed to the upper surface of bottom piece 210. For the sake of simplicity, top piece 125 and overlying bottom piece 210, if utilized, will be referred to synonymously, as unit member 210. As illustrated in FIG. 1, one or both of upper and lower sections 110 and 120 may also include doors (112, 113, 121 and 122).

Referring more particularly to FIGS. 4 through 7, pullout unit 260 suitably comprises: a tray 432, a lid 430 overlying tray 432, a working surface 450 disposed laterally adjacent to tray 432, and an extension unit 452. A tray (compartment) includes any structure for supporting a computer input device or devices, such as a keyboard and/or mouse. Tray 432 suitably includes side walls 434 and back wall 436, and is configured to accommodate a variety of computer input and ancillary devices, such as a keyboard 406 and a mouse 408, along with a wrist rest 410 and a mouse pad 412.

Working surface 450 is flat, suitable for writing or other such work, and is generally rectangular with a cut out portion of a configuration generally corresponding to, and disposed over, tray 432. The vertical position of pullout unit 260 and the height of working surface 450 above the mounting of pullout unit 260 are such that working surface 450 is positioned at an ergonomic writing height, i.e., a height within a conventionally accepted range of heights at which paper may be placed for writing with minimal stress on the human body.

Preferably, tray 432 is positioned about three inches below work surface 450, under the cut out portion. In such a position, tray 432 supports a computer keyboard having a thickness of about 1 inch at an ergonomic typing height, i.e., a height within a conventionally accepted range of heights at which a computer keyboard may be operated with minimal stress on the human body. An ergonomic typing height is generally lower than a corresponding ergonomic writing height.

Figure 4:
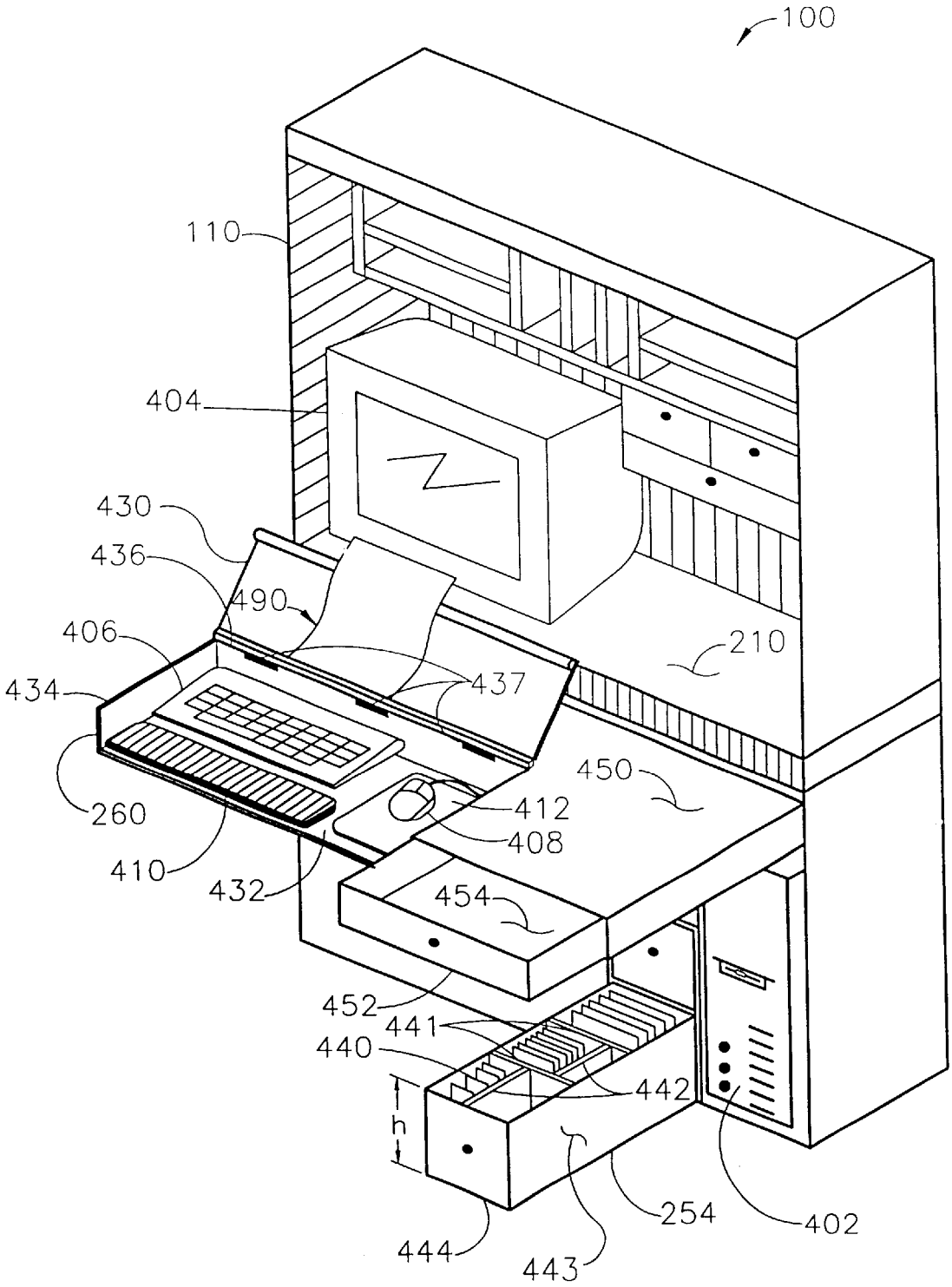
FIG. 4 is a perspective schematic view of the computer armoire of FIG. 1.
Figure 5:
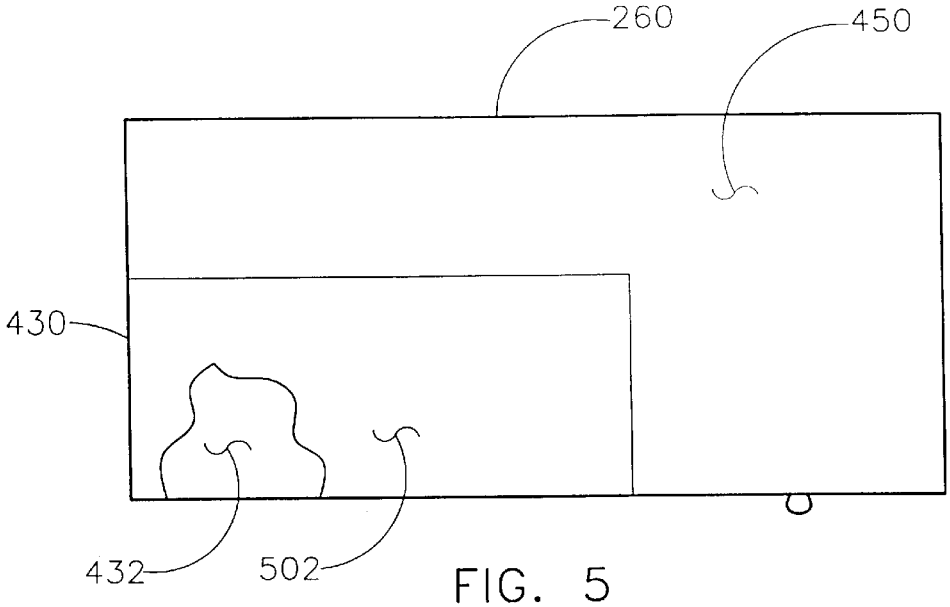
FIG. 5 is a top view of a pullout unit having a lid and an extension unit, according to various aspects of the present invention, wherein the lid is in a lowered position.
Figure 6:
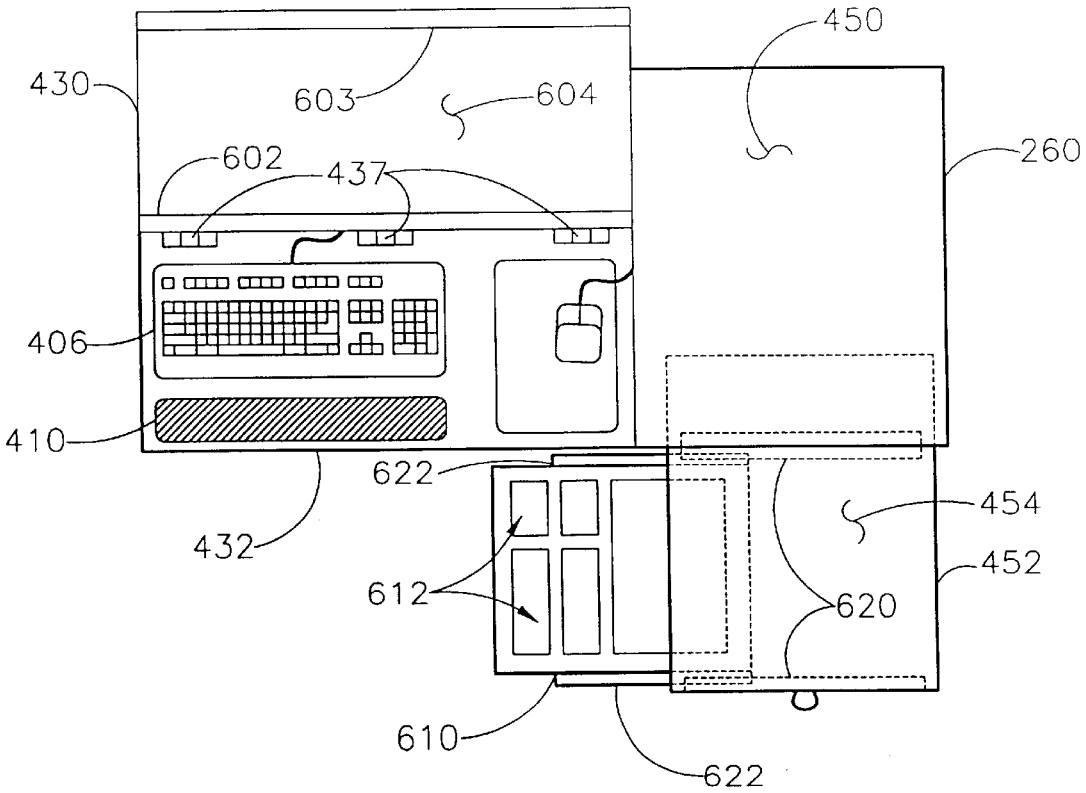
FIG. 6 is a top view of the pullout unit of FIG. 5 wherein the lid is in a raised position and the extension unit is in an extended position.

Lid 430 generally conforms in configuration to the cut out portion of working surface 450, covers tray 432, and provides an additional writing surface in a lowered position. Conversely, when in a raised position, lid 430 serves the dual purpose of providing a surface in a desirable position for supporting papers, and, in cooperation with lid stop 760, stabilizing pullout unit 260. With specific reference to FIGS. 5 and 6, lid 430 suitably includes an exterior surface 502, an interior surface 604, a top rail 603, and a bottom rail 602. As best seen in FIG. 4, lid 430 is mounted by hinges 437 to working surface back transverse wall 436, above tray 432. Lid 430 is movable between either a lowered position or a raised position, as desired. When arranged in a lowered position, as in FIG. 5, lid 430 covers tray 432 and provides exterior surface 502 as a work surface. In such a position, work surface 450 combines with lid exterior surface 502 to provide a smooth, contiguous surface for writing or other work. Preferably, lid exterior surface 502 fits closely adjacent work surface 450 when lid 430 is in a lowered position such that surfaces 502 and 450 are substantially co-planar. When arranged in a raised position, as in FIG. 6, lid 430 exposes tray 432 and provides interior surface 604 as a copy holder. When functioning as a copy holder, interior surface 604 provides a smooth, convenient place to prop up an annotate written materials. Bottom rail 602 provides a base support for such materials.

Lid exterior surface 502, becomes unavailable as a work surface when lid 430 is in a raised position. However, work surface 450 provides a surface for writing or other such work in any configuration of lid 430. To provide additional surface area for writing or other such work, extension unit 452 may be extended from pullout unit 260.

Lid exterior surface 502, becomes unavailable as a work surface when lid 430 is in a raised position. However, work surface 450 provides a surface for writing or other such work in any configuration of lid 430. To provide additional surface area for writing or other such work, extension unit 452 may be extended from pullout unit 260.

An extension unit of the present invention includes any structure that may be extended from a pullout unit to provide an additional writing surface and may provide covered storage space. For example, extension unit 452 provides additional work surface and may provide storage when extended from pullout unit 260. Extension unit 452 suitably includes work surface 454, and drawer 610. Extension unit 452 primarily has two positions: a stowed position fully within the interior space of pullout unit 260, and an extended position wherein unit 452 is fully extended from the interior space of pullout unit 260.

Figure 7:
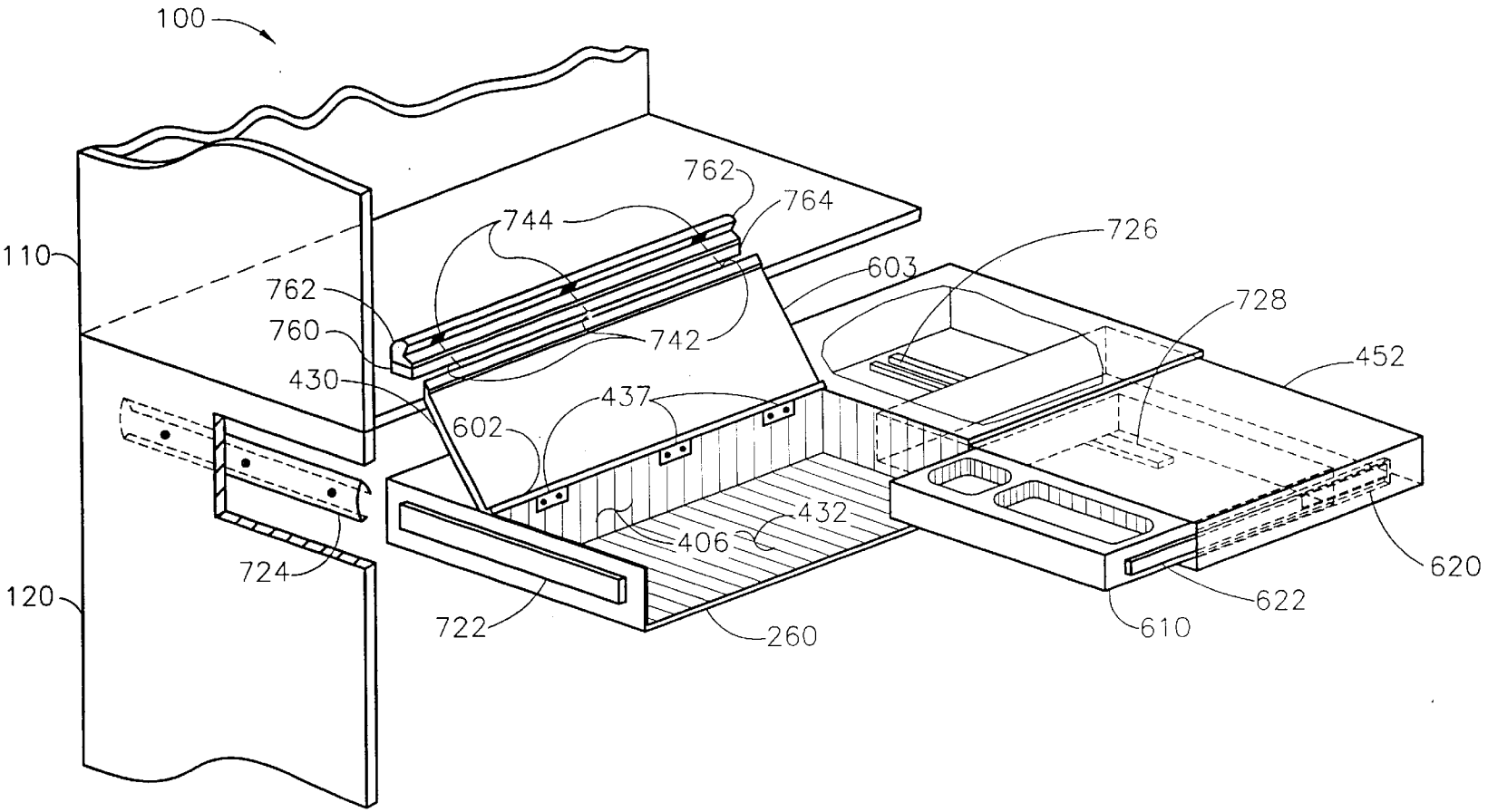
FIG. 7 is a perspective schematic view of the pullout unit of FIG. 5.

Support for pullout unit 260 and its integral elements may be provided in any manner that assures stable surfaces for equipment support and writing surfaces during operation. Any conventional mechanical support apparatus may be used, including drawer slides, hinges, cantilevered arms, and/or scissor-type hinges. In the arrangement of FIG. 7 pullout unit 260 is supported on a pair of drawer slides. The rail portions of these drawer slides 724 are mounted to the interior of lower section 120. The slide portions 722 of these drawer slides are mounted to respective sides of pullout unit 260. These drawer slides may have a locking mechanism for locking pullout unit in its extended position. The inconvenience of operating drawer slide locking mechanisms is avoided when locking mechanisms are omitted from drawer slides and pullout unit 260 is held in its extended position by the cooperation of lid 430 and lid stop 760.

Extension unit 452 is supported on a conventional drawer glide which includes rail 726 mounted to the interior of pullout unit 260 and glide 728 mounted to the underside of extension unit 452. Two sets of drawer glides may be used for improved stability and improved weight capacity for drawer 610.

Drawer 610 includes a sectioned interior formed in any conventional manner. For example drawer 610 may include recesses 612 milled from or formed in a solid piece of material, or a conventionally manufactured drawer with a plastic injection molded tray removably inserted therein. Drawer 610 is supported in extension unit 452 by drawer slides. For example rails 620 are fastened to the interior of extension unit 452 and slides 622 are fastened to drawer 610.

A lid stop, according to various aspects of the present invention, supports a lid and applies a compression force to the lid. For example, lid 430 rests on lid stop 760. Lid stop 760 may apply a force through lid 430 to urge pullout unit 260 to remain in its extended position. The cooperation of lid 430 and lid stop 760 may be better understood with reference to the example of FIG. 9 and detail FIG. 9A. In the arrangement shown in FIG. 9, lid stop 760 includes base 764 and catch mount 762. Lid stop 760 may be manufactured of any material suitable for maintaining rigidity under continuous compression. For example, lid stop 760 may be formed of wood, metal or resilient plastic.

Base 764 provides a spacer for locating catch mount 762 at an appropriate height. When the height of catch mount 762 may be predetermined, catch mount 762 may be formed integrally with base 764 as one piece.

Catch mount 762 provides support for 3 conventional bullet catches 744 located to oppose 3 corresponding detent plates 742. Each bullet catch includes a spring that forces a bullet-shaped bolt against an opposing recess or detent. Detent plates 742 may be mounted in lid 430. When detents are formed in lid 430, detent plates 742 may be omitted. Detent plates may also be omitted when lid 430 is formed with a channel extending across the top edge of lid 430 to receive bullet catches 744 at any position along the channel. Catch mount 762 includes bullet catches 744 and a resting surface 902. Surface 902 supports lid 430 at an angle appropriate for use of lid 430 as a copy holder or writing surface. Surface 902 is flat and may include a resilient cushion in order to provide a stable surface across the horizontal extent of lid 430. Top rail 603 provides additional rigidity to the upper portion of lid 430. Additional rigidity of the top portion of lid 430, especially across that portion of lid 430 that comes in contact with resting surface 902, may improve the stability of lid 430 as a copy holder, as a writing surface, and as a mechanical member for retaining pullout unit 260 in its extended position.

Lid 430 operates as an effective copy holder for copy 490. By locating copy 490 directly below the display portion of monitor 404, as shown in FIG. 8, a user of computer armoire 100 may alternate between viewing monitor 404 and viewing copy 490 with minimal effort. For example, when a user's head is at an elevation as illustrated in FIG. 8, alternately viewing monitor 404 and copy 490 may be accomplished within viewing angle VA. Viewing angle VA is preferably an ergonomic viewing angle. An ergonomic viewing angle is an angle within a conventional range through which a line of sight may pass without movement of the head. By avoiding movement of the head, stress on the human body is minimal.

Figure 2:
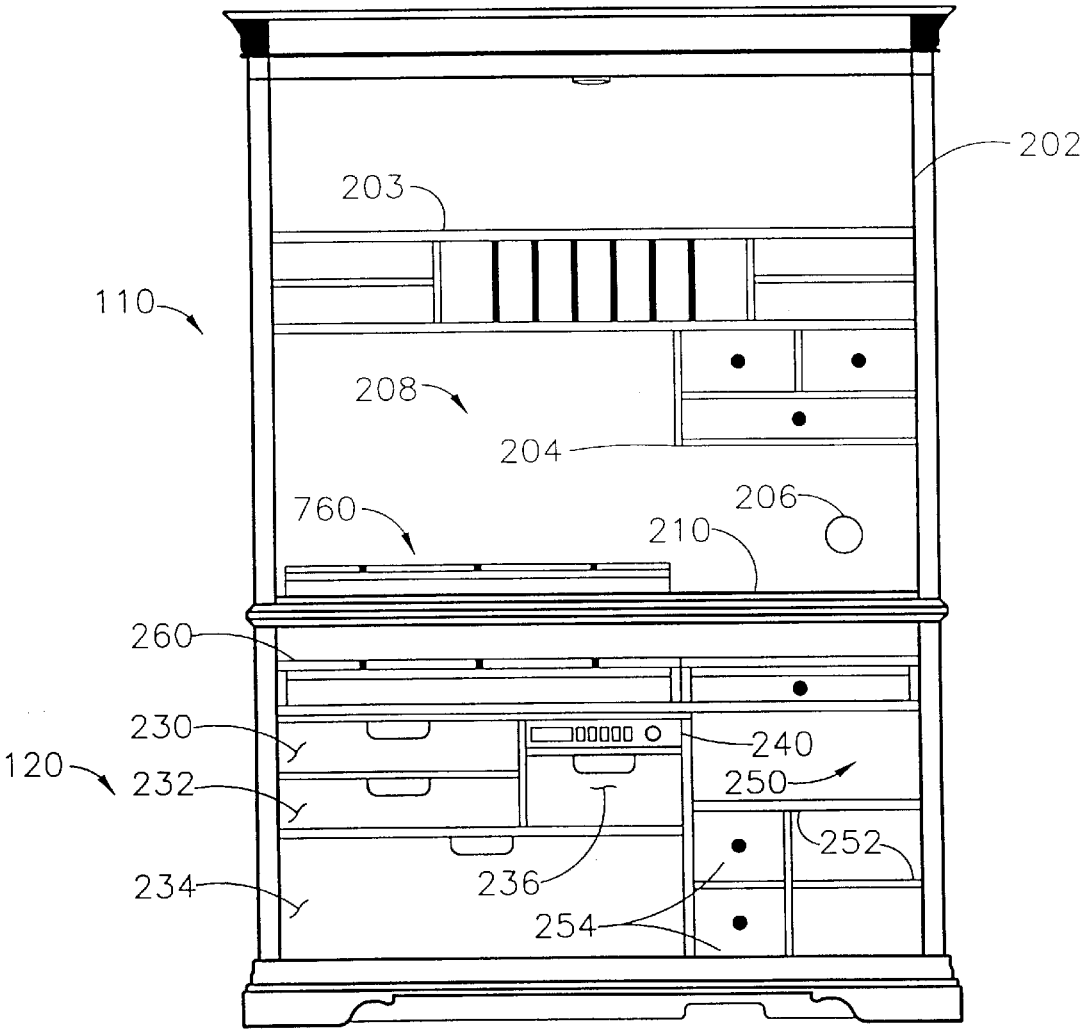
FIG. 2 is a front view of the interior of the computer armoire of FIG. 1.

Referring more particularly to FIGS. 2 and 4, base section 120 may suitably include, (in addition to pullout unit 260): various storage facilities such as drawers 230, 232, and 236; lateral file drawer 234, media drawers 254; a power center 240; and interior space 250 with respective removable/adjustable shelves therein. Drawers 230, 232, and 236 provide covered storage space, for example, suitable for computer supplies and office tools. In addition, the contents of drawers in lower section 120 may be more conveniently viewed by the user. Lateral file drawer 234 is placed near the bottom of lower section 120 for convenient access to file contents and for lowering the center of gravity of armoire 100. Lower section 120 may include only structure for supporting pullout unit 260, in which case, storage spaces as discussed above are omitted.

Interior space 250 accommodates the main unit of the computer system in either a desktop or tower orientation. Media drawers 254 and shelving 252 occupy space 250 in an arrangement of the type described in U.S. Pat. No. 5,741,053 issued Apr. 21, 1998 to Nielsen, incorporated herein by reference.

Power center 240 provides a central distribution point for power to the computer system components. Power center 240 may provide power for accessory equipment such as a desk lamp.

The arrangement of FIG. 4 provides a convenient work environment for computer system components with pullout unit 260 in its operating position. Computer system components may include main unit 402, monitor 404, and suitable input devices. Such input devices may include, for example, keyboard 406 and mouse 408.

Lower section 120 may include a media drawer 254. Media drawer 254 extends from computer armoire 100 to provide vertical access to computer media stored within the of drawer. Media drawer 254 may include a divided interior 440 conventionally formed by one or more independent or cooperating dividers 441 and 442. Each separator may be positioned in one or more fixed pre-determined positions or may be located using for example conventional hook and loop fasteners at a variable and reconfigurable position within drawer 254. A divider may be supported by an interior surface of drawer 254 and/or a portion of another divider. Dividers 441 and 442 and/or drawer sides 443 may extend vertically to a height much less than the height "h" of drawer face 444 and media to allow easy grasping of media. When used with media having a height in the range of 3 to 6 inches, drawer sides and dividers may have a height of about 2.5 inches.

Top rail 603 of lid 430 supports copy 490 in part at a distance from surface 604. Space 810 permits convenient grasping of copy 490 and avoids electrostatic adhesion of copy 490 to surface 604.

Upper section 110 and lower section 120 cooperate to provide a convenient work environment for a computer user. Interior structures of sections 110 and 120 provide storage for computer accessories and support for computer equipment. For example, interior structures may be arranged as shown in FIG. 2. Upper section 110 suitably includes covered bookshelf 202, shelving 203, drawer unit 204, and an equipment support surface 210. Covered bookshelf 202 provides book shelf space suitable for books relating to operation of a computer and its application programs. Shelving 203 provides space suitable for incoming and outgoing paperwork, notes, and work in progress. Drawer unit 204 provides covered storage space suitable for computer supplies and office tools. Interior space 208 is arranged to be occupied largely by equipment and/or peripherals of a computer system. A hole 206 is suitably included to provide a passage for power cables and signal cables. Lid stop 760 is rigidly mounted to equipment support surface 210 and performs functions as described with reference to FIG. 7. Upper section 110 may be omitted and lid stop 760 may be mounted to surface 125.

Figure 3:
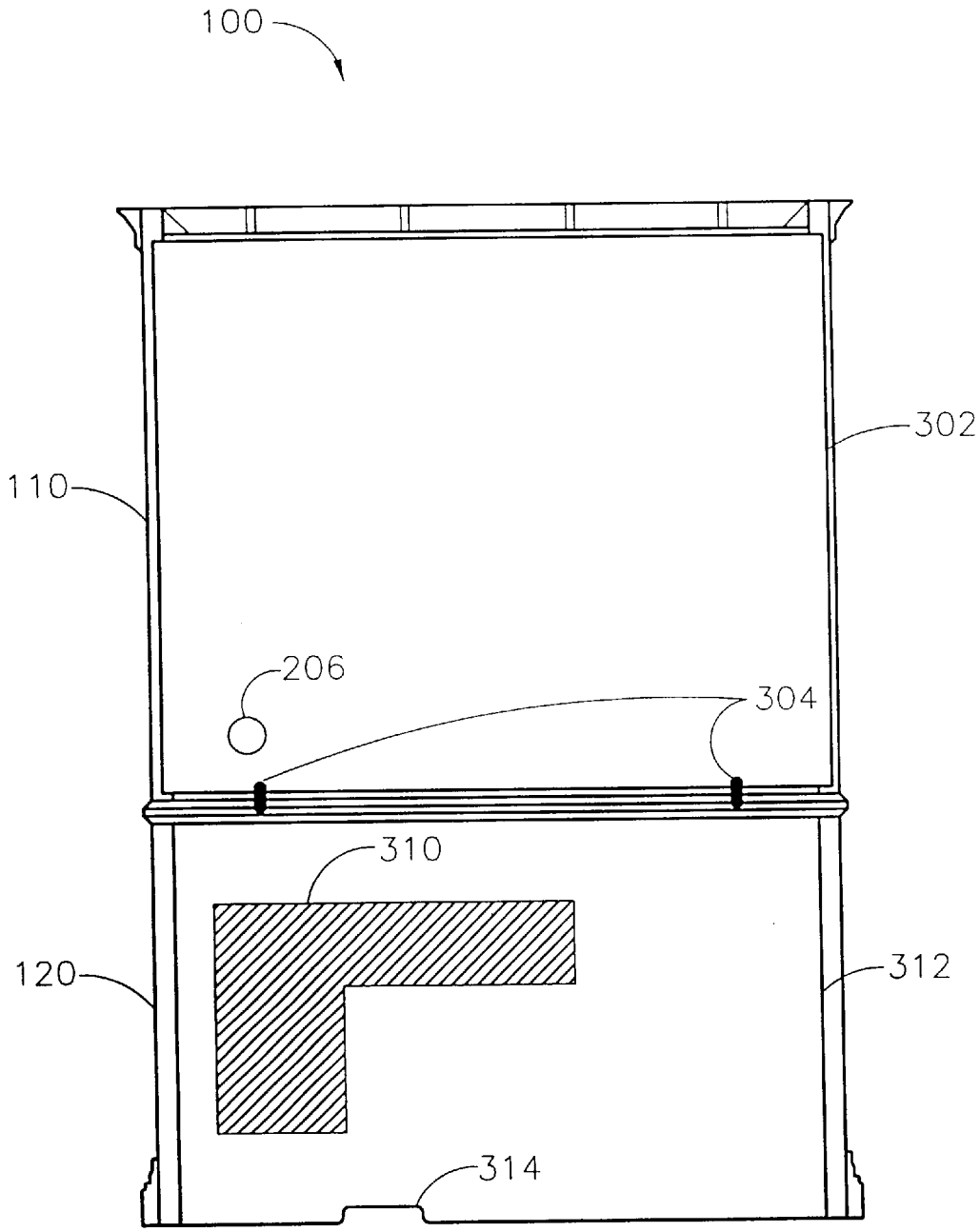
FIG. 3 is a back view of the exterior of the computer armoire of FIG. 1.

Upper section 110 and lower section 120 may be secured together for equipment and personnel safety. Rigid attachment may be provided in any suitable manner, for example using fasteners 304, as shown in FIG. 3. Rear panel 312 may include cable cutouts 310 and 314 for passage of power and signal cables and for ventilation.

Upper and lower sections 110 and 120, respectively, are suitably constructed of conventional materials using conventional techniques suitable for home or office furniture.

The arrangement of internal structures of upper section 110 and lower section 120 as well as the arrangement of the elements of pullout unit 260 are shown for convenient use by a right-handed person. For use by a left-handed person, suitable alternate locations for the structures discussed above are used to permit convenient use. The width of a computer armoire may be extended beyond that shown in the figures so that an extension unit is provided on both the left-hand and right-hand sides of tray 432. This arrangement is particularly convenient for the ambidextrous person.

While the present invention has been described in terms of preferred embodiments and generally associated methods, it is contemplated that alterations and permutations thereof will become apparent to those skilled in the art upon a reading of the specification and study of the drawings. The present invention is not intended to be defined by the above description of preferred exemplary embodiments. Rather, the present invention is defined variously by the issued claims. Each variation of the present invention is intended to be limited only by the recited limitations of its respective claim, and equivalents thereof, without limitation by terms not present therein.

What is claimed is:

1. A pullout unit comprising:

(a) a computer keyboard tray adapted for being extended from a provided support;

(b) a first writing surface adjacent the tray;

(c) a lid mounted to the tray and movable with respect to the tray from a first lid position to a second lid position, the lid at the first lid position providing a second writing surface over the tray, wherein access to the first writing surface for writing is unaffected by the lid being in either the first lid position or the second lid position, the lid in the second lid position providing a third writing surface; and (d) an extension unit mounted adjacent the tray in the pullout unit and movable from a first extension unit position to a second extension unit position, the extension unit at the second extension unit position providing a fourth writing surface.

2. The pullout unit of claim 1 further comprising a drawer in the extension unit and movable from a first drawer position to a second drawer position, the drawer being closer to the tray at the second drawer position than at the first drawer position.

3. The pullout unit of claim 1 further comprising a base supporting the pullout unit for extending from the base, wherein in combination the pullout unit and base comprise a workstation.

4. The pullout unit of claim 3 wherein the base comprises a top and wherein the pullout unit is mounted under the top.

5. The pullout unit of claim 4 wherein the pullout unit is mounted to the base by at least one drawer slide operative for extending the pullout from the base.

6. A workstation comprising (a) a pullout unit comprising:

(1) a computer keyboard tray;

(2) a first writing surface adjacent the tray; and (3) a lid mounted to the tray and movable with respect to the tray from a first lid position to a second lid position, the lid at the first lid position providing a second writing surface over the tray, wherein access to the first writing surface for writing is unaffected by the lid being in either the first lid position or the second lid position, the lid in the second lid position providing a third writing surface;

(b) a base that supports the pullout unit;

(c) a lid stop, fixed to the base, that receives the lid at the second lid position; and (d) an extension unit mounted adjacent the tray in the pullout unit and movable from a first extension unit position to a second extension unit position, the extension unit at the second extension unit position providing a fourth writing surface.

7. The workstation of claim 6 further comprises a drawer mounted in the extension unit and movable from a first drawer position to a second drawer position, the drawer being closer to the tray at the second drawer position than at the first drawer position.

8. The workstation of claim 6 wherein the workstation comprises a desk.

9. The workstation of claim 6 wherein the workstation comprises an armoire.

10. The workstation of claim 6 wherein the workstation comprises a cabinet.

11. A workstation comprising:

A pullout unit adapted to be extended from the workstation and comprising:

(a) a computer keyboard tray;

(b) a first writing surface adjacent the tray;

(c) a lid mounted to the pullout unit and movable with respect to the tray from lid position to a second lid position, the lid at the first lid position providing a second writing surface over the tray, wherein access to the first writing surface for writing is unaffected by the lid being in either the first lid position or the second lid position, the lid in the second lid position providing a third writing surface; and (d) an extension unit mounted adjacent the tray in the pullout unit and movable from a first extension unit position to a second extension unit position, the extension unit at the second extension unit position providing a fourth writing surface; and a base that supports the pullout unit.

12. The workstation of claim 11 wherein the workstation comprises a desk.

13. The workstation of claim 11 wherein the workstation comprises an armoire.

14. The workstation of claim 11 wherein the workstation comprises a cabinet.

15. The workstation of claim 11 wherein the pullout unit further comprises a drawer movably mounted in the extension unit.

* * * * *